US006772617B1

(12) United States Patent
Allen

(10) Patent No.: US 6,772,617 B1
(45) Date of Patent: Aug. 10, 2004

(54) METHOD AND APPARATUS FOR IN-SITU LEVELING OF PROGRESSIVELY FORMED SHEET METAL

(75) Inventor: Jeffrey Peter Allen, Naugatuck, CT (US)

(73) Assignee: GenCell Corporation, Southbury, CT (US)

( * ) Notice: Subject to any disclaimer, the term of this patent is extended or adjusted under 35 U.S.C. 154(b) by 0 days.

(21) Appl. No.: 10/350,863

(22) Filed: Jan. 24, 2003

(51) Int. Cl.[7] ..... B21D 25/04
(52) U.S. Cl. ..... 72/302; 72/379.6
(58) Field of Search ..... 72/295, 296, 302, 72/385, 379.6

(56) References Cited

U.S. PATENT DOCUMENTS

| | | | | | |
|---|---|---|---|---|---|
| 2,352,442 | A | * | 6/1944 | Loewy | 72/302 |
| 3,430,476 | A | * | 3/1969 | Duda | 72/385 |
| 4,169,917 | A | | 10/1979 | Baker et al. | 429/26 |
| 4,175,165 | A | | 11/1979 | Adlhart | 429/30 |
| 4,233,833 | A | * | 11/1980 | Balinski | 72/385 |
| 4,476,197 | A | | 10/1984 | Herceg | 429/32 |
| 4,510,212 | A | | 4/1985 | Fraioli | 429/30 |
| 4,548,876 | A | | 10/1985 | Bregoli | 429/38 |
| 4,604,331 | A | | 8/1986 | Louis | 429/35 |
| 4,631,239 | A | | 12/1986 | Spurrier et al. | 429/39 |
| 4,702,973 | A | | 10/1987 | Marianowski | 429/41 |
| 4,751,838 | A | * | 6/1988 | Voges | 72/302 |
| 4,753,857 | A | | 6/1988 | Hosaka | 429/38 |
| 4,781,996 | A | | 11/1988 | Toriya et al. | 429/36 |
| 4,853,301 | A | | 8/1989 | Granata, Jr. et al. | 429/39 |
| 4,857,420 | A | | 8/1989 | Maricle et al. | 429/30 |
| 4,977,041 | A | | 12/1990 | Shiozawa et al. | 429/26 |
| 4,978,589 | A | | 12/1990 | Shiozawa et al. | 429/26 |
| 4,983,472 | A | | 1/1991 | Katz et al. | 429/38 |
| 5,084,364 | A | | 1/1992 | Quaadvliet | 429/34 |
| 5,227,256 | A | | 7/1993 | Marianowski et al. | 429/16 |

(List continued on next page.)

FOREIGN PATENT DOCUMENTS

| | | | | |
|---|---|---|---|---|
| CH | 168501 | * | 7/1934 | 72/302 |
| DE | 4206490 | | 9/1993 | |
| DE | 19821767 A1 | | 11/1999 | |
| EP | 007 078 | | 1/1980 | |
| JP | 61024158 | | 2/1986 | |
| JP | 07-022038 | | 1/1995 | |
| JP | 2002-100381 A | | 4/2002 | |
| SU | 158862 | * | 11/1963 | 72/302 |
| WO | WO 98/21773 | | 5/1998 | |

OTHER PUBLICATIONS

"Punch Presses," Fundamental Manufacturing Processes Video Series Study Guide, Society of Manufacturing Engineers, 2 pages, www.sme.org (1997).

"What's New in Turret Punch Press Tooling," 3 pages, http://www.mmsonline.com/articles/01003.html (2003).

Shunsuke et al., "Flat Solid Electrolyte Fuel Cell," English translation of JP Patent No. 07022038, *Patent Abstracts of Japan* (1995).

"The ERCO Stretch–Press," (release/product sheet) Prototyping at Wayne Foundry, 2 pages (2003).

*Primary Examiner*—Daniel C. Crane
(74) *Attorney, Agent, or Firm*—Banner & Witcoff, Ltd.

(57) ABSTRACT

A stretch-forming press for stamping continuously fed sheet metal includes a ram, a base member, and a feed mechanism configured to advance a strip of sheet metal through the stretch-forming press. A forming station has a die configured to form a desired pattern in the strip of sheet metal. A leveling station has a pair of opposed jaws slidably received in corresponding recesses of the stretch-forming press, with the jaws oriented at an angle with respect to a direction of travel for the strip of sheet metal as it passes through the leveling station.

29 Claims, 4 Drawing Sheets

U.S. PATENT DOCUMENTS

| | | | | |
|---|---|---|---|---|
| 5,298,342 | A | 3/1994 | Laurens et al. | 429/35 |
| 5,362,578 | A | 11/1994 | Petri et al. | 429/35 |
| 5,424,144 | A | 6/1995 | Woods, Jr. | 429/35 |
| 5,460,897 | A | 10/1995 | Gibson et al. | 429/39 |
| 5,482,792 | A | 1/1996 | Faita et al. | 429/30 |
| 5,503,945 | A | 4/1996 | Petri et al. | 429/35 |
| 5,527,363 | A | 6/1996 | Wilkinson et al. | 29/623.1 |
| 5,558,955 | A | 9/1996 | Breault et al. | 429/38 |
| 5,707,755 | A | 1/1998 | Grot | 429/40 |
| 5,726,105 | A | 3/1998 | Grasso et al. | 442/326 |
| 5,733,682 | A | 3/1998 | Quadakkers et al. | 429/210 |
| 5,770,327 | A | 6/1998 | Barnett et al. | 429/32 |
| 5,773,160 | A | 6/1998 | Wilkinson et al. | 429/13 |
| 5,773,161 | A | 6/1998 | Farooque et al. | 429/34 |
| 5,776,624 | A | 7/1998 | Neutzler | 429/26 |
| 5,795,665 | A | 8/1998 | Allen | 429/12 |
| 5,798,187 | A | 8/1998 | Wilson et al. | 429/26 |
| 5,798,188 | A | 8/1998 | Mukohyama et al. | 429/34 |
| 5,811,202 | A | 9/1998 | Petraglia | 429/35 |
| 5,833,822 | A | 11/1998 | Hsu | 204/270 |
| 5,846,668 | A | 12/1998 | Watanabe | 429/32 |
| 5,858,567 | A | 1/1999 | Spear, Jr. et al. | 429/12 |
| 5,922,485 | A | 7/1999 | Enami | 429/26 |
| 5,942,349 | A | 8/1999 | Badwal et al. | 429/34 |
| 6,033,794 | A | 3/2000 | George et al. | 429/24 |
| 6,037,073 | A | 3/2000 | Besmann et al. | 429/34 |
| 6,040,073 | A | 3/2000 | Okamoto | 429/26 |
| 6,040,075 | A | 3/2000 | Adcock et al. | 429/32 |
| 6,040,076 | A | 3/2000 | Reeder | 429/35 |
| 6,045,934 | A | 4/2000 | Enami | 429/30 |
| 6,045,935 | A | 4/2000 | Ketcham et al. | 429/30 |
| 6,048,633 | A | 4/2000 | Fujii et al. | 429/32 |
| 6,048,634 | A | 4/2000 | Kaufman et al. | 429/34 |
| 6,048,636 | A | 4/2000 | Naoumidis et al. | 429/44 |
| 6,050,331 | A | 4/2000 | Breault et al. | 165/168 |
| 6,051,330 | A | 4/2000 | Fasano et al. | 429/30 |
| 6,051,331 | A | 4/2000 | Spear, Jr. et al. | 429/34 |
| 6,054,228 | A | 4/2000 | Cisar et al. | 429/18 |
| 6,054,231 | A | 4/2000 | Virkar et al. | 429/34 |
| 6,071,635 | A | 6/2000 | Carlstrom, Jr. | 429/34 |
| 6,071,636 | A | 6/2000 | Mosdale | 429/34 |
| 6,074,692 | A | 6/2000 | Hulett | 427/115 |
| 6,080,502 | A | 6/2000 | Nölscher et al. | 429/34 |
| 6,096,450 | A | 8/2000 | Walsh | 429/34 |
| 6,099,984 | A | 8/2000 | Rock | 429/39 |
| 6,103,415 | A | 8/2000 | Kurita et al. | 429/34 |
| 6,117,580 | A | 9/2000 | Nitschké | 429/34 |
| 6,261,710 | B1 | 7/2001 | Marianowski | 429/34 |

* cited by examiner

METHOD AND APPARATUS FOR IN-SITU LEVELING OF PROGRESSIVELY FORMED SHEET METAL

FIELD OF THE INVENTION

This invention relates to sheet metal stampings formed by progressive stamping tools and, more particularly, to a method and apparatus for the leveling of stamped sheet metal to remove or avoid unwanted distortions.

BACKGROUND OF THE INVENTION

Sheet metal is a common material used in mass-production manufacturing. Progressive tooling is often used to mass-produce items from a coil of sheet metal by passing the sheet metal through a tool or series of tools, e.g., a stamping press or stretch-forming press, that progressively shape and form the item being produced. Precise control of the feeding distance (or pitch) of the tool that performs the stamping, the feeding rate of the coil of sheet metal, and the frequency (open and shut frequency of the press determined by crankshaft RPM) is required.

In instances where the finished product is punched out of the coil and collected in a bin, such as in the case of circular or semi-spherical metal shells, the remaining portion of the coil of sheet metal is recycled as scrap. In these instances, pilot holes may be punched into the coil in areas of the coil adjacent to the areas being worked by the tooling. The pilot holes may be used to guide and regulate the feeding of the coil through the progressive tooling. In other instances, for example, in the manufacture of bipolar plates for electrochemical fuel cells, the finished product is the stamped coil itself. These coils are typically fed through a stretch-forming press by rollers.

Stretch-forming is a sheet metal forming process that is well known and that has been applied to numerous sheet metal products, for example, to the production of bipolar plates for fuel cells as described in commonly owned U.S. patent application Ser. No. 09/714,526, entitled Fuel Cell Bipolar Separator Plate and Current Collector Assembly and Method of Manufacture, filed on Nov. 16, 2000, the entire disclosure of which is incorporated herein by reference for all purposes.

Stretch-forming is performed in a manner that prevents the drawing-in of adjacent sheet metal into the tooling as the stretch-forming is performed. In the area where the sheet metal is stretched to its desired form, it is elongated well beyond the yield point of the material. Upon opening of the stretch-forming tool, the sheet metal will undergo spring-back or snap-back to relieve residual stress in the sheet metal. The amount of snap-back may be as much as several thousandths of an inch per inch, depending on the mechanical properties of the sheet metal.

In certain cases, peripheral areas of the sheet metal are not stretch-formed by the tooling. For example, when producing continuous components, such as bipolar plates for fuel cells, peripheral edge portions of the sheet metal coil are not stretch-formed and are subsequently processed to operate as seal areas. As the sheet metal coil is progressively stretch-formed as it passes through a stretch-forming press, the snap-back of sheet metal will accumulate as the coil progresses through the press and, therefore, will distort the coil. Effectively, the center area of the coil that is stretch-formed becomes shorter than the adjacent edge portions of the coil that are not stretch-formed. This accumulated distortion creates problems when feeding the coil with coil feeding equipment such as roll feeds, which are used when the use of pilot holes is an impractical method of guiding and regulating the feeding of the coil. For example, pilot holes may be impractical when the material is too thin, or the end product otherwise results in an inability to punch pilot holes in the coil of material.

A need exists for a method and apparatus that will avoid distortion of sheet metal coils that are processed by stretch-forming tooling in a progressive mode, and which use roll feed equipment to advance the coil.

It is an object of the present invention to provide a method and apparatus that reduces or wholly overcomes some or all of the difficulties inherent in prior known devices. Particular objects and advantages of the invention will be apparent to those skilled in the art, that is, those who are knowledgeable or experienced in this field of technology, in view of the following disclosure of the invention and detailed description of certain preferred embodiments.

SUMMARY

In the present invention a means is provided to counter the effect of the snap-back of sheet metal that occurs as a stretch-form tool opens.

In accordance with a first aspect, a method of reducing distortion in a stamped sheet metal strip includes the steps of providing a stretch-forming press having a main forming station and a leveling station, the leveling station having a pair of jaws, each jaw being slidably received in a recess inclined at an acute angle with respective to a direction of travel of a strip of sheet metal through the stretch-forming press; stamping a desired pattern on the strip of sheet metal at the main forming station by closing the stretch-forming press; advancing the strip of sheet metal through the stretch-forming press in a direction of travel a desired distance such that the desired pattern is aligned with the leveling station; and closing the stretch-forming press such that the jaws of the leveling station engage the strip of sheet metal and stretch a portion of the strip of sheet metal containing the desired pattern in the direction of travel a selected distance as the jaws slide into the respective recesses when the stretch-forming press is closed.

In accordance with a second aspect, a stretch-forming press for continuous feed sheet metal includes a ram, a base member, and a feed mechanism configured to advance a strip of sheet metal through the stretch-forming press. A forming station has a die configured to form a desired pattern in a strip of sheet metal. A leveling station has a pair of opposed jaws that are slidably received in corresponding recesses of the stretch-forming press. The jaws are oriented at an angle with respect to a direction of travel for a strip of sheet metal through the leveling station.

In accordance with yet another aspect, a stretch-forming press for continuous feed sheet metal includes a ram, a base member, and a feed mechanism configured to advance a strip of sheet metal through the stretch-forming press. A pre-forming station has a pair of spaced apart dies configured to mate with recesses formed in the base member to form alignment recesses in a strip of sheet metal shaped in the stretch-forming press. Each die is surrounded by a jaw, with each jaw biased toward the base member by a biasing member. A main forming station has a pair of spaced apart jaws configured to mate with alignment recesses formed in a strip of sheet metal at the pre-forming station. A die is configured to form a desired pattern in a strip of sheet metal passing through the stretch-forming press. A leveling station has a pair of opposed jaws slidably received in corresponding recesses of the stretch-forming press, and the jaws are oriented at an angle with respect to a direction of travel for a strip of sheet metal passing through the stretch-forming press.

Substantial advantage is achieved through the present invention since distortion of the sheet metal is minimized. These and additional features and advantages of the invention disclosed here will be further understood from the following detailed disclosure of certain preferred embodiments.

BRIEF DESCRIPTION OF THE DRAWINGS

The aspects of the invention will become apparent upon reading the following detailed description in conjunction with the accompanying drawings, in which.

Figure 1:
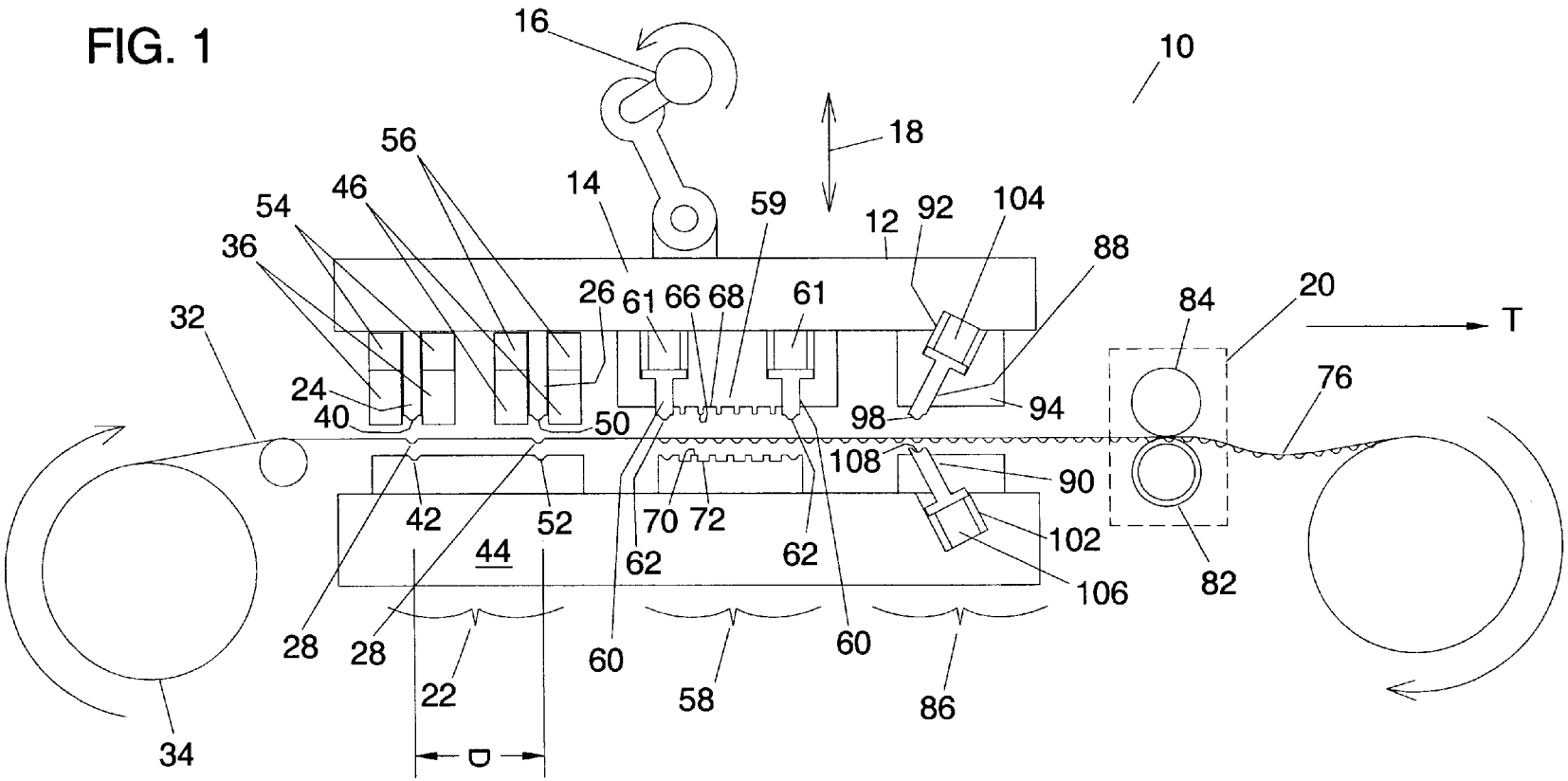
FIG. 1 is a schematic elevation view of a stretch-forming press in accordance with a preferred embodiment of the present invention, shown in its open condition.

The figures referred to above are not drawn necessarily to scale and should be understood to present a representation of the invention, illustrative of the principles involved. Some features of apparatus depicted in the drawings have been enlarged or distorted relative to others to facilitate explanation and understanding. The same reference numbers are used in the drawings for similar or identical components and features shown in various alternative embodiments. Methods and apparatus for leveling progressively formed sheet metal as disclosed herein, will have configurations and components determined, in part, by the intended application and environment in which they are used.

DETAILED DESCRIPTION OF CERTAIN PREFERRED EMBODIMENTS

A preferred embodiment of a stretch-forming press 10 in accordance with the present invention is shown in FIG. 1. Press 10 includes a progressive tool 12 having a ram 14 that is stroked by the action of a crankshaft 16, cycling progressive tool 12 between an open condition and a closed condition. The stroke 18 of the ram 14 results in a known open height and shut height of ram 14 when progressive tool 12 is in its open and closed conditions, respectively. Progressive tool 12 is comprised of three stations and a roll feeding mechanism 20 that advances a coil of sheet metal through the progressive tool. A pre-forming station 22 has a pair of spaced apart dies 24, 26 that will stretch-form two alignment recesses such as channels 28 (seen in FIG. 2) in a central portion of a sheet metal strip 32 provided from an input coil 34. Sheet metal strip 32 may be formed of any material having elastic properties that result in snap-back when the material of sheet metal strip 32 is stretch-formed. In certain preferred embodiments, e.g., when sheet metal strip 32 is used to form bipolar plates as described above, the material of sheet metal strip 32 may be, e.g., 310 stainless steel, 316 stainless steel, titanium, aluminum, nickel 200, etc.

Die 24 is surrounded by a jaw 36 and has a projection such as a rib 40 formed on its end Projection 40 is received by a recess such as a groove 42 formed in a base member 44 of progressive tool 12 that is positioned on the opposite side of sheet metal strip 32 from die 24. Similarly, die 26 is surrounded by a jaw 46 and has a projection such as a rib 50 formed on its end Projection 50 is received by a recess such as a groove 52 formed in base member 44. Jaws 36, 46 are biased by corresponding biasing members 54, 56, respectively, into engagement with base member 44, thereby tightly gripping sheet metal strip 32 between jaws 36, 46 and base member 44, and preventing the draw-in of sheet metal strip 32 when progressive tool 12 is closed. In a preferred embodiment, biasing members 54, 56 are urethane rubber pads. Biasing members 54, 56 may be springs or any other suitable resilient member that will bias jaws 36, 46 into engagement with base member 44.

Figure 3:
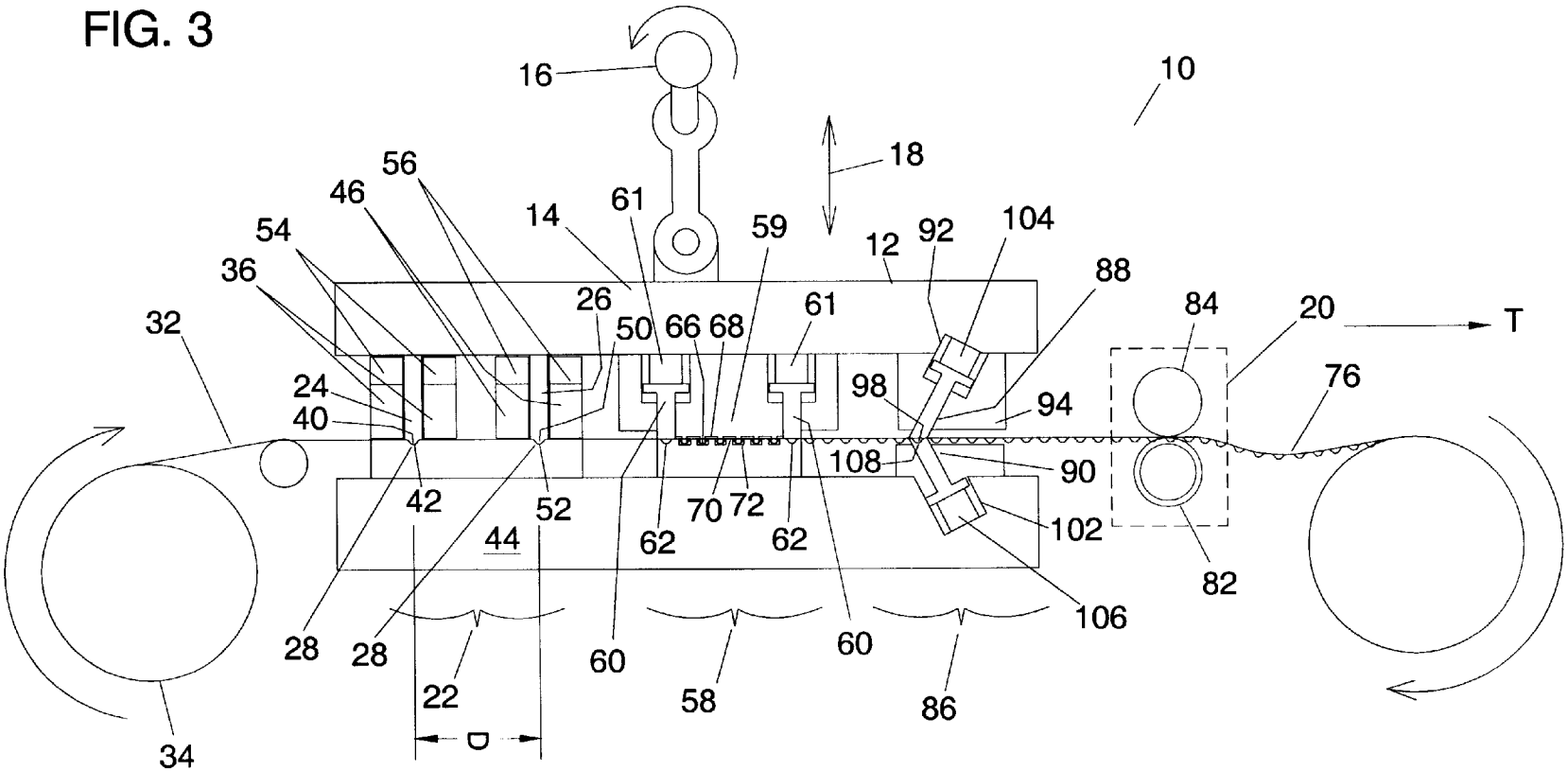
FIG. 3 is a schematic elevation view of the stretch-forming press of FIG. 1, shown in its closed condition.

In operation, as progressive tool 12 starts to close, sheet metal strip 32 is grasped tightly between jaws 36, 46 and base member 44. As progressive tool 12 closes further, dies 24, 26 are pressed into engagement with corresponding grooves 42, 52, respectively, stretch-forming channels 28 into sheet metal strip 32, as seen in FIG. 3. Since sheet metal strip 32 is grasped tightly between jaws 36, 46 and base member 44, no material is drawn into the stretch-formed regions of the sheet metal strip 32 from beyond jaws 36, 46. This prevents the non stretch-formed areas of the sheet metal strip 32 from being distorted.

Dies 24, 26 and, therefore, channels 28, are spaced apart a distance D from one another, which is referred to as the pitch of the stamping being formed, as described in greater detail below. After channels 28 have been stretched-formed, progressive tool 12 is opened, and sheet metal strip 32 is advanced in a direction of travel T through progressive tool 12. In certain preferred embodiments, sheet metal strip 32 is advanced by feed mechanism 20 the distance D such that the trailing channel 28 of the two channels 28 formed at pre-forming station 22 is aligned with die 26. Thus, a series of channels 28, each spaced a distance D from one another, can be formed, allowing a continuously stamped sheet metal strip to be formed.

A main forming station 58 is positioned downstream, with respect to the direction of travel T, of pre-forming station 22. Forming station 58 includes a die 59 and a pair of jaws 60, preferably spaced apart by distance D. In a preferred embodiment, jaws 60 include projections such as ribs 62 on ends thereof, which cooperate with recesses such as grooves 64 formed in base member 44 to grasp channels 28 of sheet metal strip 32 as progressive tool 12 closes. Die 59 also includes a pattern such as a plurality of ribs 66 and grooves 68 positioned between jaws 60, which mate with a corresponding pattern such as ribs 70 and grooves 72 formed in base member 44.

Jaws 60 are biased by biasing members 61 into engagement with base member 44, thereby tightly gripping sheet metal strip 32 between jaws 60 and base member 44. In a preferred embodiment, biasing members 61 are urethane rubber pads. Biasing members 61 may be springs or any other suitable resilient member that will bias jaws 60 into engagement with base member 44. Since sheet metal strip 32 is grasped tightly between jaws 60 and base member 44, no material is drawn into the stretch-formed regions of the sheet metal strip 32 from beyond jaws 60.

As progressive tool 12 begins to close, sheet metal strip 32 is grasped tightly between jaws 60 and base member 44.

As progressive tool 12 is closed further and die 59 is pressed into engagement with base member 44, ribs 66 are received in corresponding grooves 72, and, similarly, ribs 70 are received in corresponding grooves 68, thereby stretch-forming a plurality of channels 74 into sheet metal strip 32 between the two pre-formed channels 28.

Figure 2:
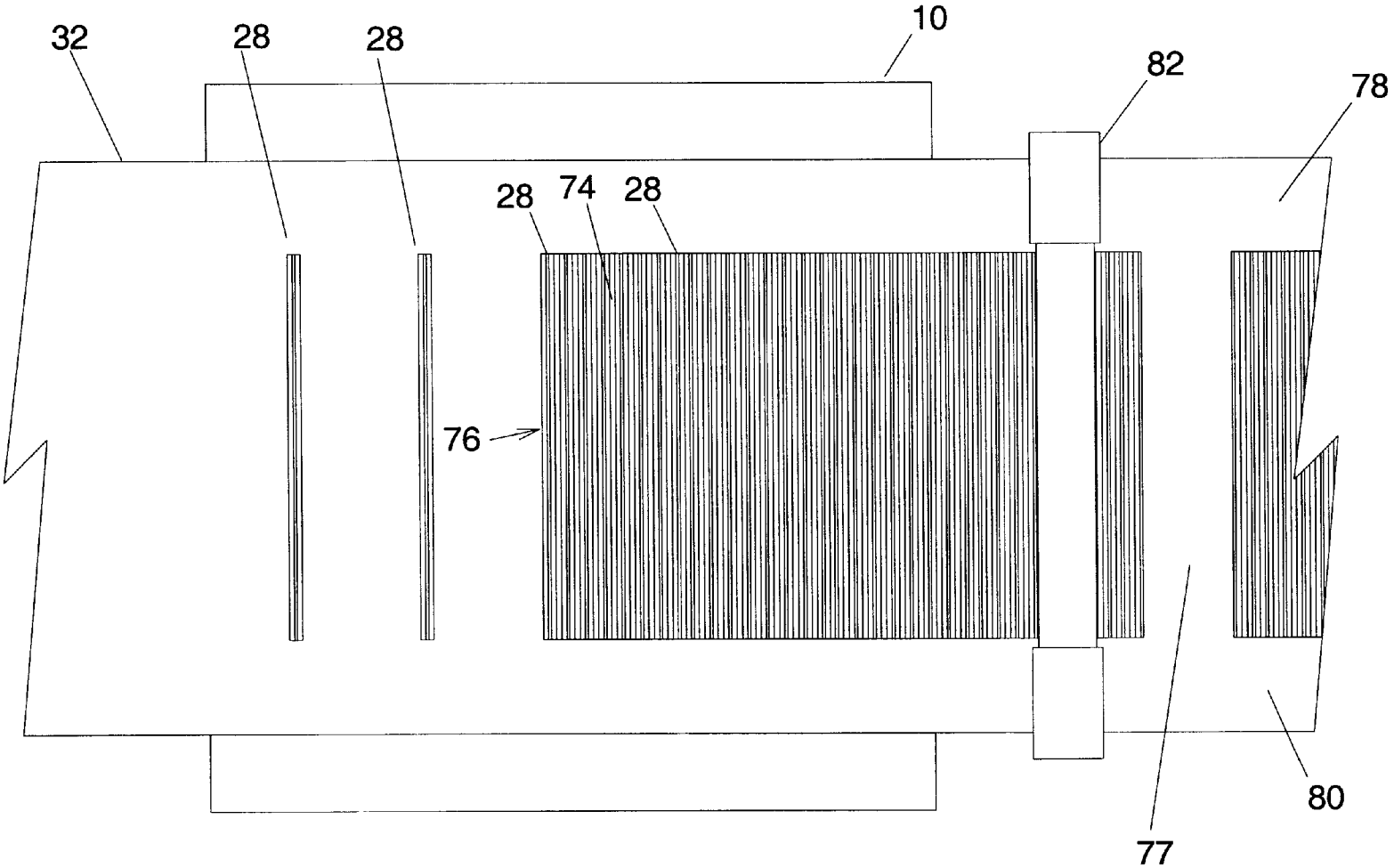
FIG. 2 is a bottom view of a sheet metal strip formed in the stretch-forming press of FIG. 1, shown with the lower half of the tooling of the stretch-forming press removed, and showing the lower roll of the roll feed mechanism of the stretch-forming press.

The additional channels 74 and the pre-formed channels 28 together comprise a stamping 76, as seen in FIG. 2. Ribs 66, 70 and grooves 68, 72 of dies 59, 61, respectively, are configured such that stamping 76 is applied only to the central portion of the sheet metal strip 32. Consequently, edge portions 78, 80 of sheet metal strip 32 are free of any channels or other stampings.

In certain preferred embodiments, auxiliary jaws with corresponding biasing members (not shown) may be provided in main forming station 58, each auxiliary jaw extending along one of the peripheral edge portions 78, 80. The auxiliary jaws act to prevent the draw-in of material from edge portions 78, 80 when channels 74 are stretch-formed, and to maintain sheet metal strip 32 in proper position.

It is to be appreciated that although the illustrated embodiment is directed to a stamping formed exclusively of channels, the present invention is not limited to such stampings, but, rather, is applicable to any desired pattern that can be stretch-formed into a strip of sheet metal. The reduction of distortion that the present invention provides is equally applicable to patterns having many different configurations, and any such configuration is considered to be within the scope of the present invention.

This process of forming channels 28, advancing sheet metal strip 32 the distance D, and forming channels 74 is repeated continuously to form a sheet having a stamping 76 extending a desired distance along sheet metal strip 32. In certain preferred embodiments, a stamping of a desired length may be created. To create a stamped sheet of a desired length, sheet metal strip 32 may be advanced a distance greater than the distance D during an open cycle of the press, e.g., a multiple of the distance D in order to ensure uniformity of stamping 76, or a sufficient distance that stamping 76 is advanced beyond progressive tool 12. This will create a non-stretch-formed area 77 in sheet metal strip 32, which will be equal in length to the distance the sheet is advanced during the open cycle. Non-stretch-formed area 77 provides an area where sheet metal strip 32 can be cut, thereby providing a stamped sheet metal plate of a desired length. In certain preferred embodiments, sheet metal strip 32 is advanced the distance 2×D to create non-stretch-formed area 77. By positioning a separate pre-forming station 22 upstream of main forming station 58, it is possible to intermittently advance the sheet metal strip 32 a distance of 2×D (or any other multiple of D) to provide a non-stamped section of the sheet metal strip 32 that can be utilized to receive a cut. This non-stamped section can, in certain preferred embodiments, be folded over end caps onto leading and trailing ends of adjacent bipolar plates in the manufacture of electrochemical fuel cells.

Feed mechanism 20 serves to advance sheet metal strip 32 through progressive tool 12. In certain preferred embodiments, feed mechanism 20 is a roll feed mechanism and includes a lower roll 82 and an upper roll 84 that are driven by a motor (not shown) to pull sheet metal strip 32 the desired distance when progressive tool 12 is in its open condition, as seen in FIG. 1. In other embodiments, a feed mechanism may be configured to push sheet metal strip 32 through progressive tool 12. Pulling sheet metal through progressive tool 12 with feed mechanism 20 is a preferred embodiment when sheet metal strip 32 is thin and cannot be pushed through progressive tool 12.

Lower roll 82 is relieved in the area where stamping 76 of sheet metal strip 32 passes between lower roll 82 and upper roll 84, as can be seen in FIG. 2, in order to prevent damage to stamping 76 as sheet metal strip 32 is advanced. Thus, in this embodiment, lower roll 82 engages only the edge portions 78, 80 of sheet metal strip 32 as it cooperates with upper roll 84 to pull sheet metal strip 32 through progressive tool 12.

Figure 4:
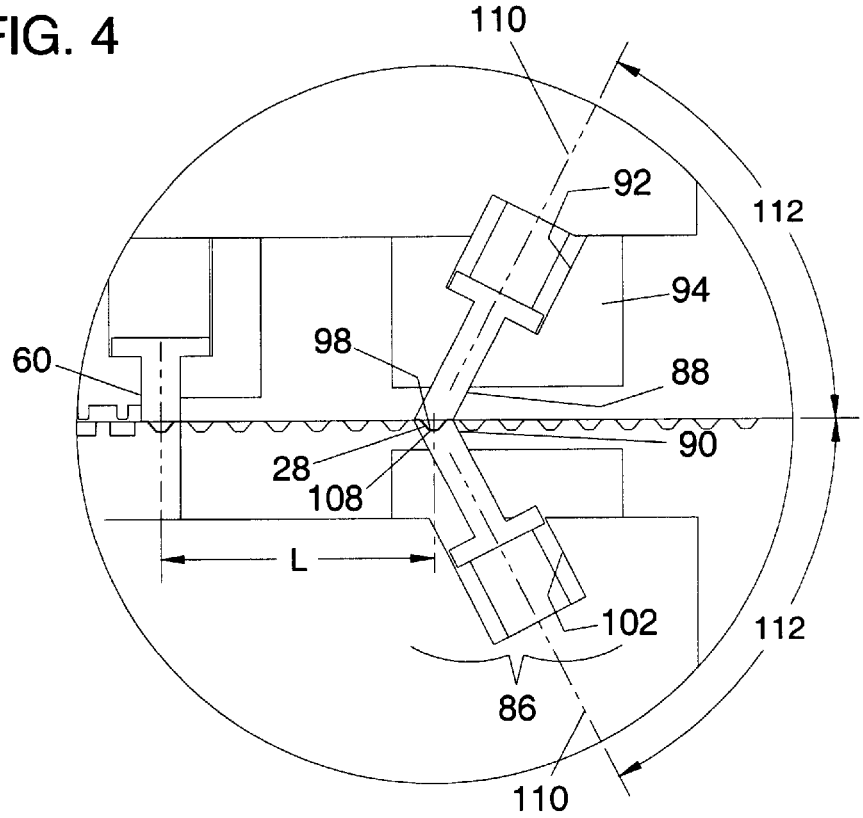
FIG. 4 is an enlarged elevation view of the leveling station of the stretch-forming press of FIG. 1, showing the jaws of the leveling station in their initial contact condition.

A leveling station 86, seen more clearly in FIG. 4, is positioned downstream, with respect to the direction of travel T, of forming station 58, and serves to reduce distortion created in sheet metal strip 32 at forming station 58 when stamping 76 is created. Leveling station 86 includes a pair of jaws 88 and 90, which are positioned on opposite sides of sheet metal strip 32. Jaw 88 is slidably received in a recess 92 formed in a jaw housing 94. Jaw 88 has a projection such as a rib 98 on one end thereof that is configured to mate with a corresponding channel 28 of sheet metal strip 32. Jaw 90 is slidably received in a recess 102 formed in base member 44. Jaw 90 has a recess such as a groove 108 on one end thereof configured to mate with a the corresponding channel 28 of sheet metal strip 32 when progressive tool 12 is closed, such that jaws 88, 90 cooperate to tightly grasp sheet metal strip 32.

Jaws 88, 90 are biased by biasing members 104, 106, respectively, into engagement with each other, thereby tightly gripping sheet metal strip 32 between them. In a preferred embodiment, biasing members 104, 106 are urethane rubber pads. Biasing members 104, 106 may be springs or any other suitable resilient member that will bias jaws 88, 90 into engagement with each other.

As noted above, sheet metal strip 32 is advanced through progressive tool 12 to leveling station 86 by feed mechanism 20 the distance D such that rib 98 of jaw 88 and groove 108 of jaw 90 are properly aligned with a corresponding channel 28. As progressive tool 12 starts to close, jaws 88, 90 tightly grasp sheet metal strip 32 along the corresponding channel 28. As illustrated in FIG. 4, progressive tool 12 is at a position of initial contact with sheet metal strip 32. At this point, the distance L between the most downstream jaw 60 of forming station 58 and jaws 88, 90 of leveling station 86 is equal to the distance D less the snap-back distance of the sheet metal that is, the pitch of stamping 76 less the snap-back distance.

Figure 5:
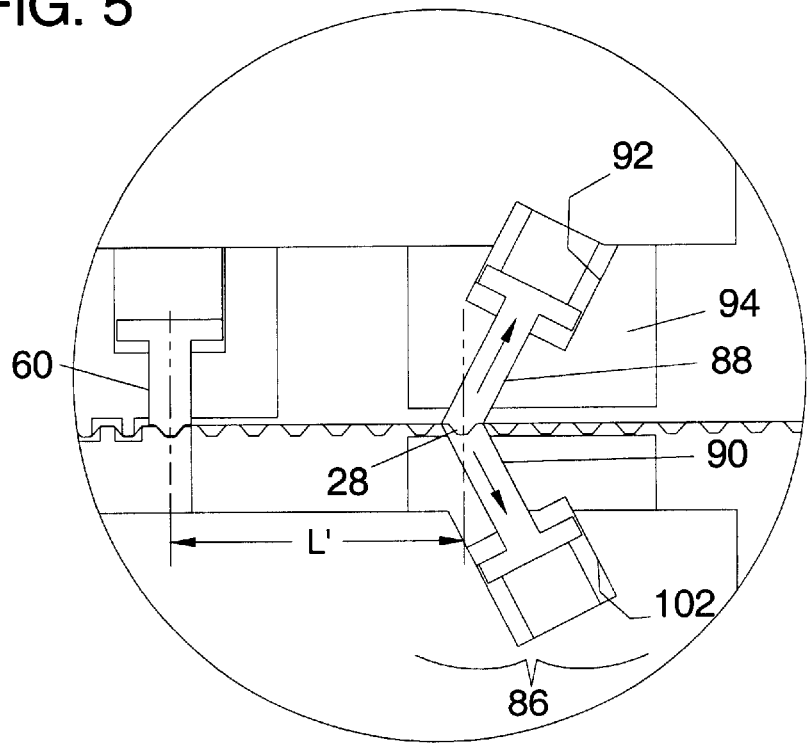
FIG. 5 is an enlarged elevation view of the leveling station of the stretch-forming press of FIG. 1, showing the jaws of the leveling station in their closed, recessed condition.

As progressive tool 12 closes further, jaws 88, 90 retract into corresponding recesses 92, 102, respectively, to the position illustrated in FIG. 5, where ram 14 is shown in its lowest position and progressive tool 12 is shown being completely closed.

Recesses 92, 102 are configured such that a centerline of travel 110 of each of jaws 88, 90 is at an acute angle 112 with respect to the direction of travel T of sheet metal strip 32. Thus, as jaws 88, 90 retract, they do so at angle 112 with respect to the direction of travel T of sheet metal strip 32. Accordingly, the movement of each of jaws 88, 90 consists of both a vertical and horizontal component. More specifically, jaws 88, 90 move both in a perpendicular direction, that is, in a direction substantially perpendicular to the direction of travel T of sheet metal strip 32 (vertically as seen in the illustrated embodiment of FIG. 5), and in a lateral direction, that is, a direction parallel to and in the direction of travel T of sheet metal strip 32 (horizontally as seen in the illustrated embodiment of FIG. 5). Thus, when progressive tool 12 is in its fully closed position, jaws 88, 90 are spaced a distance L' from the most downstream jaw 60 of forming station 58, which is a distance greater than the distance L.

The lateral motion of jaws 88, 90 at the pre-formed channel 8 has the effect of stretching stamping 76 in the direction of travel T of sheet metal strip 32, resulting in an over-pull of stamping 76. When progressive tool 12 is opened, each of pre-forming station 22, main forming station 58 and leveling station 86 release stamping 76, and the over-pull produced by jaws 88, 90 in leveling station 86 snaps back an amount necessary to eliminate the residual stress of stamping 76 relative to the un-stamped peripheral edge portions 78, 80. Angle 112 is sized such that jaws 88, 90 stretch sheet metal strip 32 an amount capable of countering effects of snap-back that result from stamping the desired pattern. By pulling and snapping back stamping 76, stress in sheet metal strip 32 is effectively leveled, and processing of sheet metal strip 32 may proceed in progressive continuous mode without accumulation of distortion and without roll feeding problems.

In light of the foregoing disclosure of the invention and description of the preferred embodiments, those skilled in this area of technology will readily understand that various modifications and adaptations can be made without departing from the scope and spirit of the invention. All such modifications and adaptations are intended to be covered by the following claims.

What is claimed is:

1. A method of reducing distortion in a stamped sheet metal strip comprising the steps of:

providing a stretch-forming press having a main forming station and a leveling station, the leveling station having a pair of jaws, each jaw being slidably received in a recess inclined at an acute angle with respective to a direction of travel of a strip of sheet metal through the stretch-forming press;

stamping a desired pattern on the strip of sheet metal at the main forming station by closing the stretch-forming press;

advancing the strip of sheet metal through the stretch-forming press in a direction of travel a desired distance such that the desired pattern is aligned with the leveling station; and closing the stretch-forming press such that the jaws of the leveling station engage the strip of sheet metal and stretch a portion of the strip of sheet metal containing the desired pattern in the direction of travel a selected distance as the jaws slide into the respective recesses when the stretch-forming press is closed.

2. The method of claim 1, wherein the acute angle and a resultant travel distance of the jaws along the recess are sized such that the selected distance is sufficient to counter effects of snap-back that result from stamping the desired pattern.

3. The method of claim 1, wherein the desired pattern comprises a plurality of channels.

4. The method of claim 1, further comprising the steps of:

providing a pre-forming station in the stretch-forming press upstream, with respect to the direction of travel, of the main forming station; and stamping a pair of spaced apart channels in the strip of sheet metal at the pre-forming station.

5. The method of claim 4, wherein the distance between the spaced apart channels is the same distance as the desired distance.

6. The method of claim 4, wherein the step of stamping the spaced apart channels is performed by a pair of dies.

7. The method of claim 6, wherein each die is surrounded by a jaw biased into engagement with a base member of the stretch-forming press by a urethane rubber pad.

8. The method of claim 1, wherein the step of advancing the strip of sheet metal is performed by a pair of rollers.

9. The method of claim 1, further comprising the steps of:

opening the stretch-forming press;

advancing the strip of sheet metal through the stretch-forming press;

repeating the steps of stamping a desired pattern, advancing the strip of sheet metal, closing the stretch-forming press, opening the stretch-forming press, and advancing the strip of sheet metal, a desired number of times to produce a strip of sheet metal having the desired pattern stamped continuously along its length.

10. The method of claim 9, further comprising the step of intermittently advancing the strip of sheet metal through the stretch-forming press a greater distance than that required to align the desired pattern with the leveling station when advancing the sheet metal strip from the main forming station to the leveling station in order to create a portion of the sheet metal strip along its length free of the desired pattern.

11. A stretch-forming press for continuous feed sheet metal comprising, in combination:

a ram;

a base member;

a forming station having a die configured to form a desired pattern in a strip of sheet metal;

a leveling station having a pair of opposed jaws slidably received in corresponding recesses, the jaws oriented at an angle with respect to a direction of travel for a strip of sheet metal through the leveling station, the leveling station being positioned downstream of the forming station with respect to a strip of sheet metal passing through the forming station and the leveling station; and a feed mechanism configured to advance a strip of sheet metal through the forming station and the leveling station.

12. The stretch-forming press of claim 11, wherein the die is configured to produce a plurality of channels in a strip of sheet metal.

13. The stretch-forming press of claim 12, wherein each jaw of the forming station is biased toward the other jaw by a biasing member.

14. The stretch-forming press of claim 13, wherein each biasing member comprises a urethane rubber pad.

15. The stretch-forming press of claim 11, further comprising a pre-forming station having a pair of dies configured to form a pair of alignment recesses in the sheet metal strip.

16. The stretch-forming press of claim 15, wherein the alignment recesses are channels.

17. The stretch-forming press of claim 15, wherein each of the dies of the pre-forming station is surrounded by a jaw.

18. The stretch-forming press of claim 17, wherein each jaw of the pre-forming station is biased toward the base member by a biasing member.

19. The stretch-forming press of claim 18, wherein each biasing member of the pre-forming station comprises a urethane rubber pad.

20. The stretch-forming press of claim 11, wherein one jaw of the leveling station is slidably received in a recess of the base member and the other jaw of the leveling station is slidably received in a recess formed in a jaw housing.

21. The stretch-forming press of claim 11, wherein the angle is sized such that the jaws will stretch a portion of a strip of stamped sheet metal when the ram closes on the base member a distance sufficient to counter effects of snap-back that result from forming a desired pattern on a strip of sheet metal with the forming station.

22. A stretch-forming press for continuous feed sheet metal comprising, in combination:

a ram;

a base member;

a pre-forming station having a pair of spaced apart dies configured to mate with recesses formed in the base member to form alignment recesses in a strip of sheet metal to be shaped, each die being surrounded by a jaw, each jaw biased toward the base member by a biasing member;

a main forming station having a pair of spaced apart jaws configured to mate with alignment recesses formed in a strip of sheet metal at the pre-forming station, each of the spaced apart jaws biased toward the base member by a biasing member, and a die configured to form a desired pattern in a strip of sheet metal passing through the main forming station;

a leveling station having a pair of opposed jaws slidably received in corresponding recesses of the stretch-forming press, the jaws oriented at an angle with respect to a direction of travel for a strip of sheet metal passing through the leveling station and jaw biased toward the base member by a biasing member, the leveling station being positioned downstream of the pre-forming station and the main forming station with respect to a strip of sheet metal passing through the forming station and the leveling station; and a feed mechanism configured to advance a strip of sheet metal through the pre-forming station, the main forming station, and the leveling station.

23. The stretch-forming press of claim 22, wherein the alignment recesses are channels.

24. The stretch-forming press of claim 22, wherein each biasing member of the pre-forming station, the main forming station and the leveling station is a urethane rubber pad.

25. The stretch-forming press of claim 22, wherein the dies are configured to form a plurality of channels in a strip of sheet metal.

26. The stretch-forming press of claim 22, wherein the feed mechanism comprises a pair of rollers configured to cooperate to grip a strip of sheet metal and pull it through the stretch-forming press.

27. The stretch-forming press of claim 26, wherein one of the rollers is relieved in a central portion thereof.

28. The stretch-forming press of claim 22, wherein one jaw is slidably received in a recess of the base member and the other jaw is slidably received in a recess formed in a jaw housing.

29. The stretch-forming press of claim 22, wherein the angle is sized such that the jaws will stretch a portion of a strip of stamped sheet metal when the ram closes on the base member a distance sufficient to counter effects of snap-back that result from stamping a desired pattern on a strip of sheet metal with the forming station.

* * * * *